US008858188B2

(12) United States Patent
Makarov

(10) Patent No.: US 8,858,188 B2
(45) Date of Patent: Oct. 14, 2014

(54) VACUUM PUMP OR VACUUM APPARATUS WITH VACUUM PUMP

(71) Applicant: Alexander Makarov, Bremen (DE)

(72) Inventor: Alexander Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/019,035

(22) Filed: Sep. 5, 2013

(65) Prior Publication Data

US 2014/0010676 A1 Jan. 9, 2014

Related U.S. Application Data

(63) Continuation of application No. 12/527,834, filed as application No. PCT/EP2008/001347 on Feb. 21, 2008, now Pat. No. 8,529,218.

(30) Foreign Application Priority Data

Feb. 28, 2007 (DE) ..... 10 2007 010 068

(51) Int. Cl.
*F04D 29/40* (2006.01)
*F04D 19/04* (2006.01)

(52) U.S. Cl.
USPC ..... 417/53; 417/250; 417/423.4; 415/90

(58) Field of Classification Search
USPC ..... 417/244, 250, 423.3, 53; 415/90; 250/289; 118/50, 715
See application file for complete search history.

(56) References Cited

U.S. PATENT DOCUMENTS

| | | | |
|---|---|---|---|
| 3,144,035 | A | 8/1964 | Hablanian et al. |
| 4,792,688 | A | 12/1988 | Young |
| 5,733,104 | A | 3/1998 | Conrad et al. |
| 6,140,638 | A | 10/2000 | Tanner et al. |
| 6,193,461 | B1 | 2/2001 | Hablanian |
| 6,457,954 | B1 | 10/2002 | Adamietz et al. |
| 6,464,451 | B1 | 10/2002 | Conrad et al. |
| 7,762,763 | B2 | 7/2010 | Stones |

(Continued)

FOREIGN PATENT DOCUMENTS

| | | |
|---|---|---|
| DE | 93 04 435 | 6/1993 |
| EP | 1085214 A2 | 3/2001 |

(Continued)

OTHER PUBLICATIONS

Leneman et al., "A Novel Angular Motion Vacuum Feedthrough," Review of Scientific Instruments, vol. 72 (8), Aug. 2001, pp. 3473-3474.

(Continued)

*Primary Examiner* — Nathan Zollinger
(74) *Attorney, Agent, or Firm* — Timothy J. OHara

(57) ABSTRACT

The invention relates to a vacuum pump or vacuum apparatus having a vacuum pump for the evacuation of one or a plurality of volumes, the vacuum pump having a plurality of pressure stages and at least two suction inlets. According to the invention, an outer suction inlet for a first pressure stage spatially encompasses an inner suction inlet for a second pressure stage such that the inner suction inlet seals only against pressure within the outer suction inlet, not against external pressure.

15 Claims, 3 Drawing Sheets

(56) References Cited

U.S. PATENT DOCUMENTS

| | | | |
|---|---|---|---|
| 7,811,065 | B2 | 10/2010 | Stuart et al. |
| 7,850,434 | B2 | 12/2010 | Stones |
| 7,866,940 | B2 | 1/2011 | Stones et al. |
| 8,105,013 | B2 | 1/2012 | Stones |
| 8,106,354 | B2 | 1/2012 | Henry et al. |
| 2007/0020116 | A1 | 1/2007 | Stones |
| 2007/0258836 | A1 | 11/2007 | Hofmann et al. |
| 2008/0063541 | A1 | 3/2008 | Stones |

FOREIGN PATENT DOCUMENTS

| | | | |
|---|---|---|---|
| EP | 1 090 231 | B1 | 10/2005 |
| EP | 1 422 423 | B1 | 10/2005 |
| EP | 1852613 | A2 | 11/2007 |

OTHER PUBLICATIONS

CeramTec North America Corp, "Differentially Pumped Viewports", Advertisement, Jul. 2003, www.photonics.com/printerFriendly.aspx?ArticleID=16549&Publication=6.

VACUUM PUMP OR VACUUM APPARATUS WITH VACUUM PUMP

CROSS REFERENCE TO RELATED APPLICATION

This application is a Continuation under 35 U.S.C. §120 and claims the priority benefit of co-pending U.S. application Ser. No. 12/527,834, filed Aug. 19, 2009, entitled "Vacuum Pump or Vacuum Apparatus with Vacuum Pump," which is the United States National Stage Application, under 35 U.S.C. §371, of International Application PCT/EP2008/001347, filed Feb. 21, 2008, which claims the priority benefit to German Patent Application No. 10 2007 010 068.1, filed Feb. 28, 2007, which applications are hereby incorporated herein by reference in their entireties.

FIELD OF THE INVENTION

The invention relates to a device according to the preamble of claim 1, preferably to a multi-stage turbo molecular pump for mass analyzers with a high vacuum and ultra high vacuum (UHV). In particular, it relates to applications in connection with electrostatic analyzers or ion traps. Other types of analyzers can also be used. In principle, it relates to specifics of the vacuum system from which evacuation is effected efficiently by using multi-stage pumps. This also includes a method according to the invention for evacuation. Preferred, but not limiting, possibilities for applying the invention are lasers, X-ray fluorescence spectroscopy, (X-ray) photoelectron spectroscopy (XPS, PES), interferometers, wafer coating, sputtering, physical vapor deposition, and particle accelerators.

BACKGROUND OF THE INVENTION

Multi-stage pumps are widely used, particularly in combination with mass spectrometers because of the possibility of reducing the overall costs, size and complexity of the installation without endangering the high vacuum pump performance. It is conventional for the best vacuum and suction capability to be present at an inlet, while subsequent inlets provide a vacuum lying between the best vacuum and the external pressure. Two particularly important designs are known:

- a multi-port split-flow pump, as disclosed in U.S. Pat. No. 6,464,451 and EP 0 603 694, with each inlet having an individual vacuum seal against atmospheric pressure.
- a multi-port split-flow pump, as disclosed in U.S. Pat. No. 6,464,451 and EP 0 603 694, with each inlet having an individual vacuum seal against atmospheric pressure.
- cartridge split-flow pumps, as disclosed in EP 1 422 423 and EP 1 090 231, with the pump being arranged within a suitable structure and being inserted into a housing with the latter. Typically, only the outlet in the vicinity of the pump outlet is provided with a seal against atmospheric pressure, while other outlets are only sealed against one another.

Both approaches cause difficulties at an inlet of the pump or at two vacuum inlets as soon as an ultra high vacuum (UHV) is intended to be attained. Since UHV generally requires conflat (or other metallic) seals, it can be difficult to implement this in a pump with a number of inlets, in particular if two vacuum inlets should have a UHV. The metallic seals require utmost accuracy in the arrangement of the seal surfaces. Should a number of inlets with metallic seals be provided, these have to be matched to one another in a precision fitting manner. With a pump arranged in a cartridge, the baking for achieving the UHV conditions has to be carried out at significantly lower temperatures to avoid damage to the bearings (of the pump rotor). The invention is intended to overcome the described problems.

DESCRIPTION OF THE INVENTION

A solution according to the invention emerges from the features of claim 1 and from the further claims. In particular, what is proposed is that the pump housing (with more than one suction inlet) is modified such that the pump inlet with the lowest pressure is not sealed against atmospheric pressure and that preferably only the outermost pump inlet has a seal against the atmospheric pressure, while every subsequent (UHV) inlet is only surrounded by regions which were evacuated by means of a preceding inlet.

Additionally, every subsequent (UHV) inlet can be separated from the previous inlet or the corresponding region by a metal-to-metal seal which does not cause significant plastic deformation of the metallic sealing material. Accordingly, an essential feature of the invention is a "vacuum-in-vacuum" arrangement with only one stage with a relatively higher pressure which requires sealing against the atmosphere while the remaining stages are preferably sealed against one another.

The solution provides an integrated approach for the design of the pump and the vacuum system which takes the particular requirements of the seal and the geometric conditions into account.

Preferred Embodiment

A preferred embodiment (cf. also FIG. 1) uses a standard turbo molecular pump which is inserted into a modified housing. For typical mass-spectroscopic applications, there can be a seal gap between seal surfaces of up to 100 microns (1 micron=$10^{-6}$ m) at a gap depth of 10 mm or more, or a gap width of <50 microns and a gap depth of approximately 5 mm, etc. A total residual leakage conductivity of approximately 10%-50% of the total residual leakage conductivity between the pressure stages in the recipient, that is to say typically <0.1 to 0.3 liters per second into the UHV inlet can normally be accepted.

In order to simplify the production, it is possible for the housing to be formed from a number of concentric parts which are pressed into one another before the final processing.

To reduce the heating of the bearings during the baking, the housing of the turbo pump can be produced from stainless steel in the customary fashion for UHV pumps. Compared to other metals, stainless steel has a low thermal conductivity.

In practice, the new system is only a different housing for an otherwise "normal" pump with channels which connect the higher pressure stages with the connection area.

In the preferred embodiment, different vacuum stages are arranged around one another, with regions of higher pressure around regions of lower pressure. Here, the upper side of the pump is accessible if the pump part is separated from the vacuum system (most pumps require access to the upper bearings for maintenance reasons). It goes without saying that the parts can also be provided in a different geometric arrangement than in the preferred embodiment.

There are numerous possibilities for sealing the various surfaces. In principle, it is important to recognize that with a suitable arrangement only the outermost region which is subject to the highest pressure requires a compressible or deformable seal. The seal between the individual (differential) pressure stages is subject to substantially smaller requirements since the leak rate there depends on the molecular flow and not on the viscous flow. The requirements of the maximum acceptable leak surface between the various stages can easily be calculated from the effective pump speed of the pump.

Optionally, the outermost seal can be formed from: all types of elastomers, including Viton; conventional metal seals are not necessary, but possible. Moreover, many polymers such as Teflon, Kel-F, etc. are possible.

The advantage of a compressible outer seal is that good contact with the inner seal surfaces can be obtained more easily.

Options for the inner seals:

Inasmuch as it is desired, the internal leak rates can be reduced by using deformable materials such as Teflon, Kel-F or soft metals.

The length of the effective leak channel between the stages can be increased. In the drawing, provision is made for a cylindrical step which protrudes around the UHV inlet (requires a fitting recess on the sides of the recipient). It is likewise possible to use flat seals (as is the case between the outermost stage and the stage adjacent thereto), preferably with polished metal surfaces.

A resilient metal sheet can be attached to the flat surface by point welding in order to ensure a narrow gap without major requirements on the tolerance.

A further preferred embodiment is explained further down in connection with FIG. 2. There, an Orbitrap housing (Orbitrap is a registered trademark of Thermo Finnigan LLC, San Jose, Calif., USA and refers to a special mass spectrometer) made of stainless steel is arranged within an aluminum chamber. The housing can rest on flexible supports which usually act on the underside of the Orbitrap housing so that the latter projects below the underside of the chamber by a small amount (preferably 0.1 to 0.2 mm). If the pump housing is held from below and evacuated, the Orbitrap housing is acted upon by an upward movement corresponding to this amount until there is a reliable surface-to-surface contact between the metal surfaces. This effects a good seal between the surfaces and makes relatively short leak paths possible (approximately 2 to 5 mm).

Since the stainless Orbitrap housing is only connected to the aluminum chamber by thin ribs, the latter act as heat barriers. This makes it possible to heat the housing to over 100° C. to 150° C. (or 200° C. or more), while the aluminum housing remains below 50° C. to 60° C. Naturally, it is preferably only the heat path to the chamber which is produced from a material with a poor thermal conductivity such as stainless steel, while the Orbitrap housing can for the rest be composed of aluminum. If the pump housing is likewise produced from stainless steel, the part thereof facing away from the rotors can be heated to over 80° C. to 100° C., while the rotors and bearings remain below 50° C. to 60° C.

Advantages of the Invention

Multiple inlets can be produced concentrically, only the outermost seal is an elastomer but not the seals in the UHV.

UHV sealing can be attained by differential pumping of potential leaks using the preceding inlets. This is particularly economical if different pressure stages are present in the recipient in any case.

The use of metal-to-metal seals, which permit residual leakage flows and which are effective without plastic deformation of corresponding metals, makes it possible to attain the required leak rates for mass spectroscopic applications. This affords the possibility of simple and quick replacement of the pumps.

The lack of plastic deformation of metals in the region of the vacuum seals means that the vacuum chamber itself can be produced from a softer material such as aluminum, or even a composite which has metal only in the UHV region and is otherwise made of polymers.

The arrangement permits simple maintenance and replacement of the pump in the case of faults or at regular intervals. Provision is made for a "maintain surface" of simple design with moderate requirements regarding evenness.

Reduced requirements of the mechanical precision are possible compared to a "cartridge" design (EP 1 422 423).

Further features of the invention emerge from the remaining claims and the following description. Advantageous embodiments of the invention will be explained in more detail based on the drawings, in which FIG. 1 shows a schematic diagram (in part as a cross section) of an analyzer with a vacuum pump, with one pump evacuating a number of chambers via a number of pressure stages;

Figure 2:
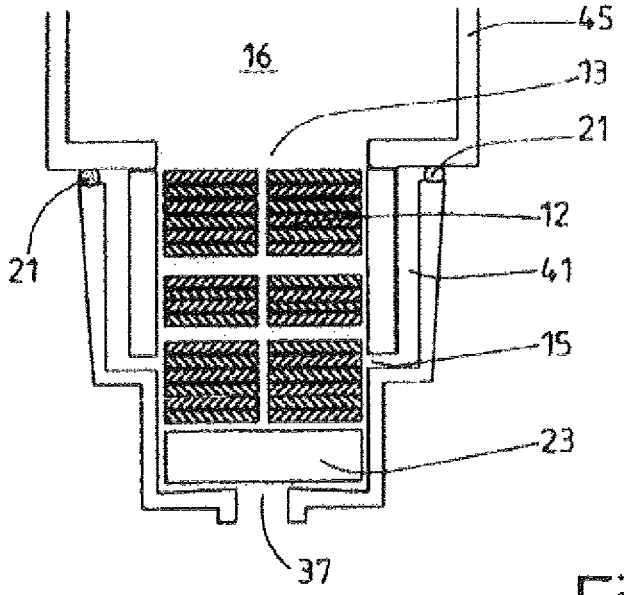
FIG. 2 shows a vacuum pump which has a number of pressure stages but only evacuates one chamber.
Figure 3:
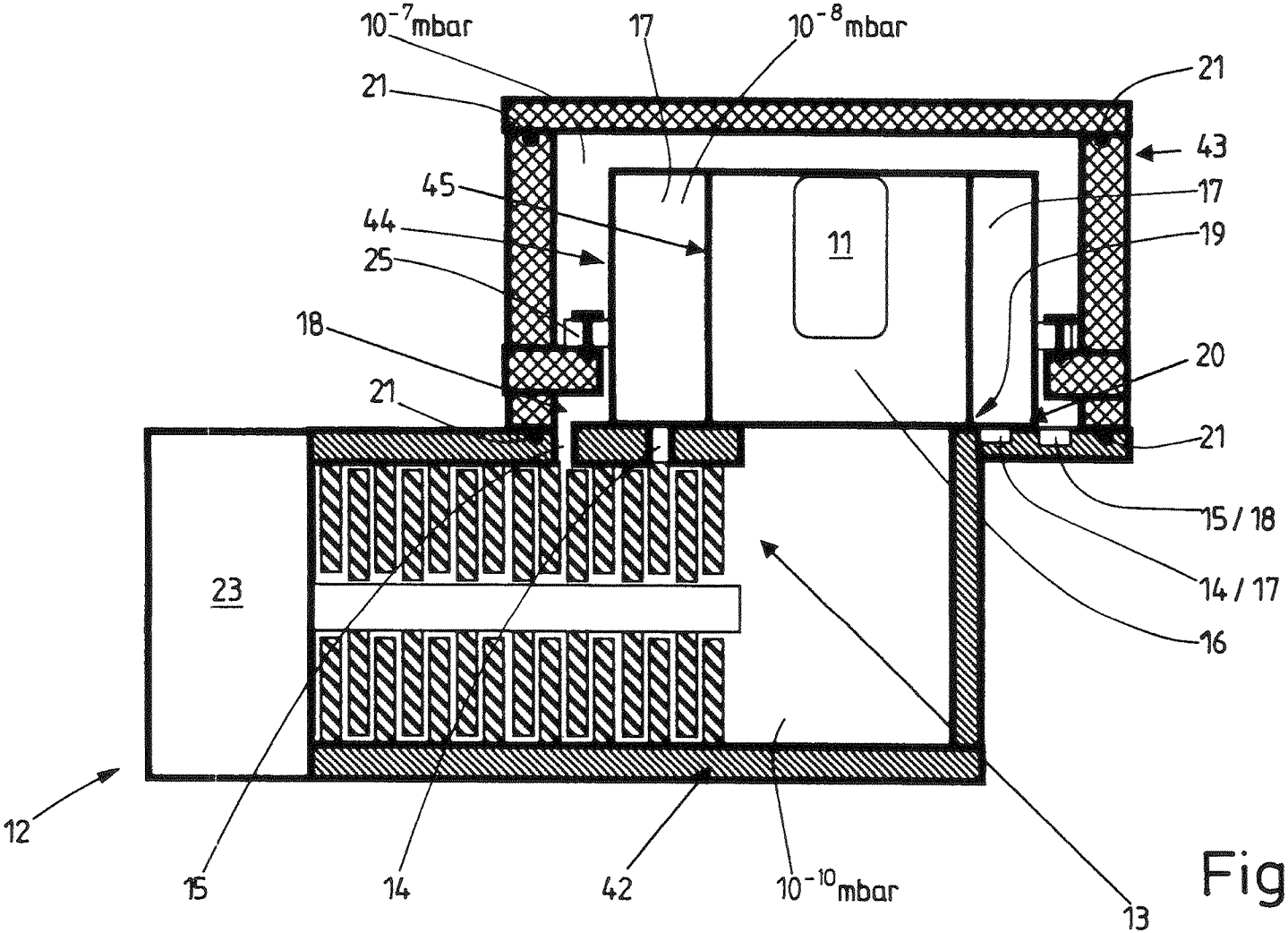
FIG. 3 shows a schematic diagram analogous to that of FIG. 1.
Figures 4A, 4B:
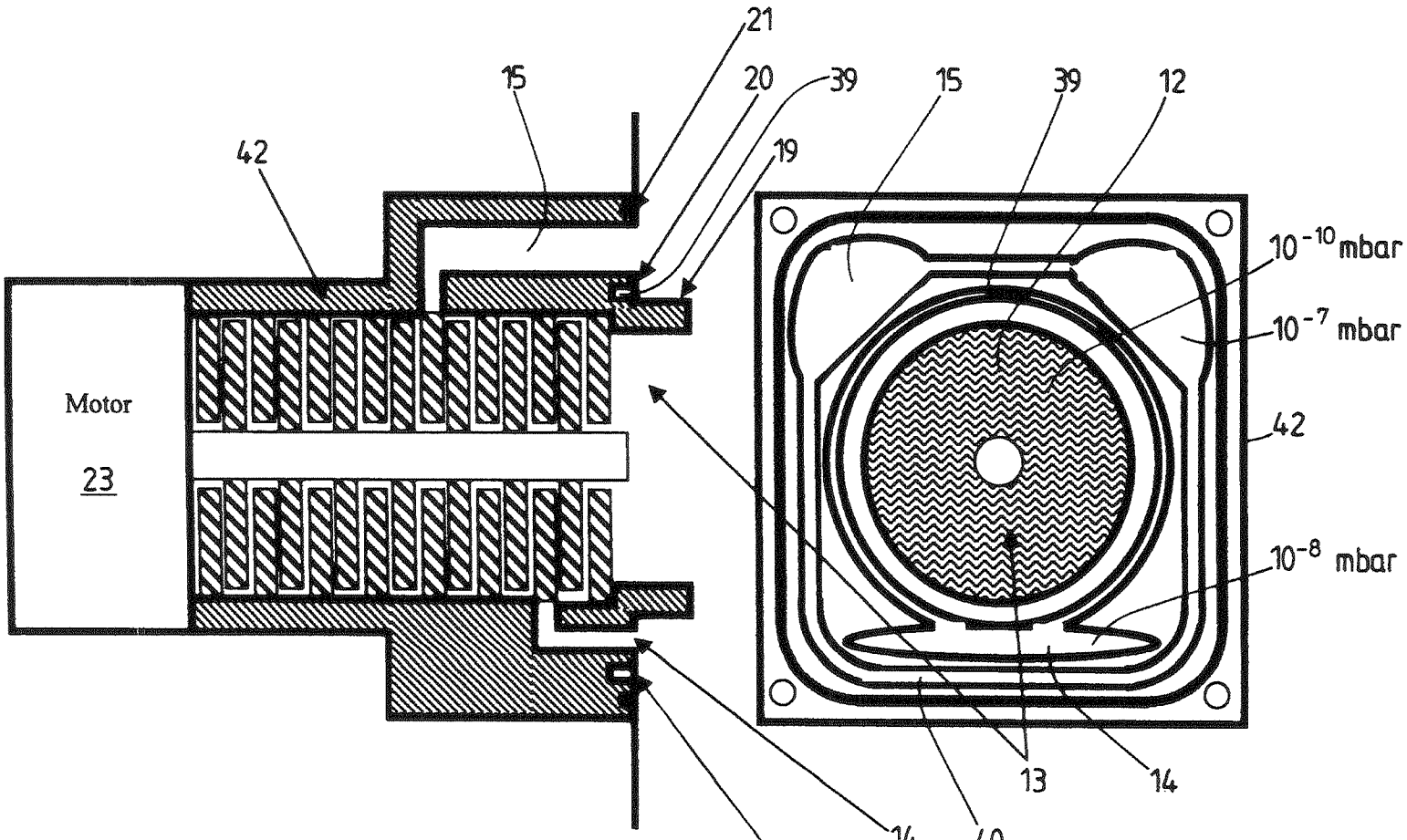

FIG. 4*a* shows a schematic diagram similar to FIG. 2, specifically an alternative embodiment of the vacuum pump in accordance with FIG. 3 but with an arrangement rotated by 90° for connecting it to an analyzer housing; and FIG. 4*b* shows a front view of the vacuum pump in accordance with FIG. 4*a*.

Figure 1:
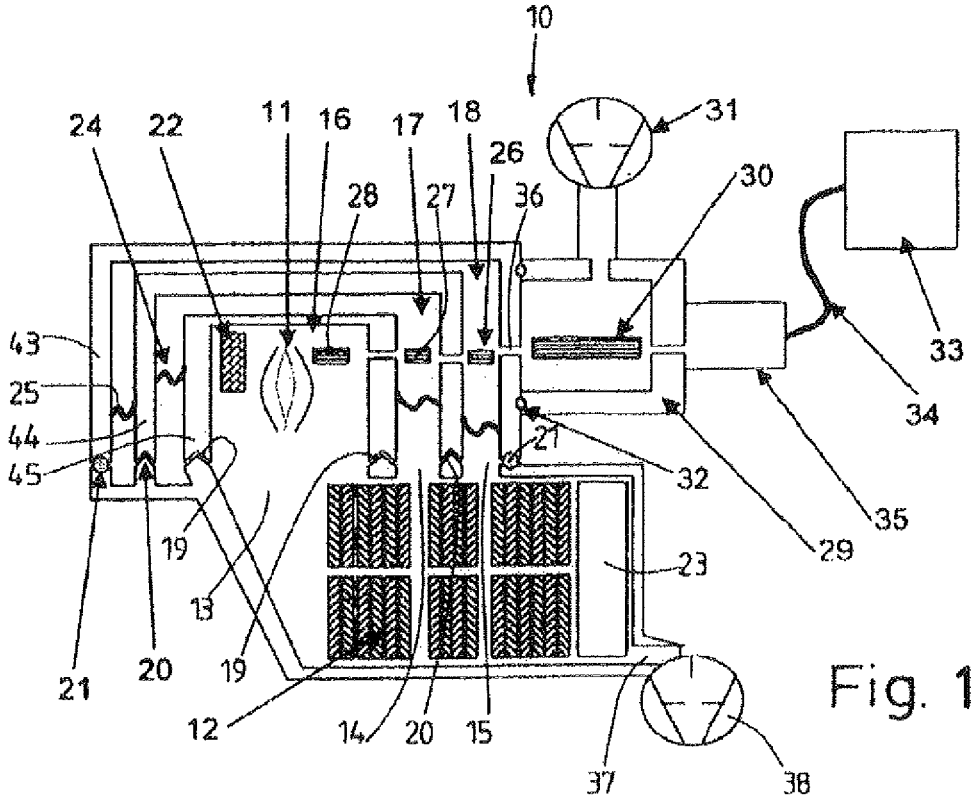

In FIG. 1, a mass spectrometer 10 has an analyzer 11 in the style of an electrostatic trap with a hyper-logarithmic field and a vacuum pump 12 connected to the analyzer 11, the motor axis of said pump being approximately parallel to the ion flow entering the analyzer 11. The vacuum pump 12 is of multistage design and has three suction inlets 13, 14, 15. There is a negative pressure of approximately $10^{-10}$ mbar at the suction inlet 13; at the suction inlets 14, 15 it is approximately $10^{-8}$ mbar and $10^{-7}$ mbar. The pressure conditions at the suction inlets 13 and 14 are referred to as an ultra high vacuum (UHV) in this case.

The analyzer 11 is arranged within an inner vacuum chamber 16 which is connected to the suction inlet 13. Accordingly, vacuum chambers 17, 18 are connected to the suction inlets 14, 15. Said chambers surround the inner vacuum chamber 16. Moreover, the outer vacuum chamber 18 surrounds the central vacuum chamber 17. In this case, "surrounding" means that the inner vacuum chamber 16 seals against the central vacuum chamber 17 in the region of the transition to the vacuum pump 12. A correspondingly encircling seal gap is referred to by the numeral 19. Analogously, provision is made for an encircling seal gap 20 between the central vacuum chamber 17 and the outer vacuum chamber 18.

Finally, the outer vacuum chamber 18 has an outer encircling seal gap 21, into which a sealant of compressible or deformable material is inserted in this case, preferably a polymeric sealing ring. The encircling seal gaps 19, 20 are illustrated in this case without an additional sealant. However, the seal gaps 19, 20 are preferably angled or curved to increase the effective path lengths. The goal is a long path length s compared to the cross-sectional area A of the respective seal gap 19, 20 which is as small as possible.

During operation, the three vacuum chambers 16, 17 18 are simultaneously evacuated by the multistage pump 12. Here, only the outer vacuum chamber 18 is sealed against atmospheric pressure. By contrast, the pressure differences between the vacuum chambers 16 and 17 on the one hand, and 17 and 18 on the other hand, are only small. Also, there is only a molecular flow along the seal gaps 19, 20 and so the total residual leakage conductivity is typically orders of magnitude smaller than in the case of a viscous flow. A substantial advantage of this arrangement is that the seal at the seal gap 21 does not have to be 100% sealed against the outer pressure (atmospheric pressure). A small leak rate can be accepted provided it is not greater than, or provided it is actually only insignificant compared to the openings used for the ion transport, for example, in particular diaphragms between the pressure stages of the recipient. The quantity of leakage gas is evacuated in one of the vacuum chambers 16, 17, 18.

It is usually possible to remove the vacuum pump 12 from the mass spectrometer 10 for maintenance purposes. Accordingly, the seal surfaces in the region of the encircling seal gaps 19, 20, 21 have to be produced with high precision. The requirements of the mentioned precision are lower in the arrangement according to the invention because only one compressible seal (along the seal gap 21) is provided and this furthermore does not have to seal against the lowest pressure. Regarding the additional seal gaps 19, 20, it is sufficient if these have a small ratio of cross-sectional area A to path length s.

A heating device 22 is optionally arranged with the analyzer 11 in the interior of the vacuum chamber 16 for the purposes of baking the vacuum chamber. This eases and accelerates the evacuation process. The heat occurring in the process can damage, inter alia, the bearings of a rotor of the vacuum pump 12, not shown in any more detail, and a drive motor 23 for said rotor. This is avoided by the arrangement according to the invention. The vacuum chambers 16 and 18 are thermally insulated from one another by the central vacuum chamber 17 and so the temperature during the baking of the vacuum chamber 16 is significantly lower than at the suction inlet 13, at least in the region of the suction inlet 15. Accordingly, the drive motor 23 and the adjacent bearings are not heated. Mechanical connections 24, 25, for example for mutual support and maintaining the spacing, are made of material with particularly poor thermal conductivity. The material preferably has a poorer thermal conductivity than the walls of the respectively adjacent vacuum chambers 16 to 18. In addition to, or instead of, simply selecting materials, the thermal resistance can also be increased by dimensioning, for example by connecting webs which are only very thin in sections.

Ion optics 26, 27, 28 are arranged upstream of the analyzer 11 in the mentioned vacuum chambers 16 to 18. Optionally, an antechamber 29 with ion optics 30 and an individual pump 31 is arranged upstream of the outer vacuum chamber 18. Here, the antechamber 29 is sealed against the rest of the system, in particular against the outer vacuum chamber 18, preferably with a compression seal 32, e.g. an O-ring made of Viton.

Furthermore, provision is optionally made for a chromatograph 33, from which a suitable substance enters an ion source 35 via a feed line 24. The ions formed there enter the antechamber 29 via a gap 36, and enter the mentioned vacuum chambers 16 to 18 via corresponding further gaps.

An outlet 37 of the vacuum pump 12 in the vicinity of the drive motor 23 can be connected to a forepump 38.

The vacuum chambers 17, 18 arranged outside of the inner vacuum chamber 16 can be designed to completely encircle the inner vacuum chamber 16, or else to only partly encircle it (this can differ between chambers 17 and 18) so that in part there are only recesses in the seal surfaces, see numerals 39, 40 in FIGS. 3 and 4. Optionally, the pump housing illustrated in FIG. 1 has an additional opening which permits simple, direct access to rotor bearings facing the recipient and which is preferably flush with a rotor axis. To this end, provision can be made for a simple flange to which a pressure measurement apparatus can optionally be connected.

In the embodiment in accordance with FIG. 2, the vacuum pump 12 is only connected to the one vacuum chamber 16. The additional vacuum chambers are either evacuated separately or are not present in this embodiment. Nonetheless, two pressure stages are formed, specifically an inner pressure stage at the suction inlet 13 and an outer pressure stage with the suction inlet 15 by means of which only one encircling auxiliary chamber 41 is evacuated in this case. Here, the auxiliary chamber 41 only has the function of a difference pressure stage and of evacuating molecules entering via the seal gap 21. As in FIG. 1, a seal of compressible or deformable material is also inserted in the seal gap 21 in FIG. 2. The seal surface on the sides of the recipient can be a planar surface with only recesses or supports for attachment means, should these be necessary.

FIG. 3 shows a slight modification compared to FIG. 1. A housing 42 of the vacuum pump 12 is connected to a housing 43 surrounding the analyzer 11 and the vacuum chambers 16, 17, 18, in a manner analogous to FIG. 1. Here, a drive axis of the vacuum pump 12 is approximately perpendicular to a main axis of the connection between the suction inlet 13 and the vacuum chamber 16.

The housing 42 of the vacuum pump preferably consists of stainless steel, while the housing 43 of the chamber 18 can be produced from aluminum. In contrast, the housings 44, 45 assigned to the chambers 17, 16 are in turn preferably made of stainless steel.

Unlike FIG. 1, the chamber 17 in FIG. 3 is not led around the chamber 16 in a U-shape, but rather it only surrounds the chamber 16 in an annular fashion. Accordingly, the housings 44, 45 above the analyzer 11 in FIG. 3 form a common housing wall.

The mechanical connection shown also in FIG. 1 is provided between the housing 44 and the outer housing 43. The connection is designed such that only a thermal conduction which is as low as possible is possible from the housing 44 to the housing 43.

FIG. 4*a* shows a modification of the vacuum pump in accordance with FIG. 3, specifically with an alignment of the motor axis parallel to the direction of the gas flow between the analyzer and the pump 12 or between the vacuum chamber 16 and the suction inlet 13. This makes the shortest distance between rotor and recipient possible and hence the best effective suction performance. For the purposes of clarification, FIG. 4*b* shows a front view of FIG. 4*a*.

| List of reference symbols | |
|---|---|
| 10 | Mass spectrometer |
| 11 | Analyzer |
| 12 | Vacuum pump |
| 13 | Suction inlet |
| 14 | Suction inlet |
| 15 | Suction inlet |
| 16 | Vacuum chamber |
| 17 | Vacuum chamber |
| 18 | Vacuum chamber |
| 19 | Encircling seal gap |
| 20 | Encircling seal gap |
| 21 | Encircling seal gap |
| 22 | Heating device |

-continued

| List of reference symbols | |
|---|---|
| 23 | Drive motor |
| 24 | Mechanical connections |
| 25 | Mechanical connections |
| 26 | Ion optics |
| 27 | Ion optics |
| 28 | Ion optics |
| 29 | Antechamber |
| 30 | Ion optics |
| 31 | Forepump |
| 32 | Seal |
| 33 | Chromatograph |
| 34 | Feed line |
| 35 | Ion source |
| 36 | Gap |
| 37 | Outlet |
| 38 | Forepump |
| 39 | Recess |
| 40 | Recess |
| 41 | Auxiliary chamber |
| 42 | Vacuum pump housing |
| 43 | Housing of chamber 18 |
| 44 | Housing of chamber 17 |
| 45 | Housing of chamber 16 |

The invention claimed is:

1. A method for evacuating a vacuum assembly of an analyzer, the method comprising:

evacuating a first chamber and a second chamber of the vacuum assembly with a vacuum pump, the first chamber having a first volume and the second chamber having a second volume, the vacuum pump including a first suction inlet and a second suction inlet, the first suction inlet being connected to the first chamber and the second suction inlet being connected to the second chamber, the second volume spatially surrounding the first suction inlet; and sealing the first suction inlet only against pressure within the second volume and not against an external pressure.

2. The method of claim 1 further comprising:

sealing the second suction inlet against the external pressure.

3. The method of claim 1, in which the first chamber and the second chamber are in a nested arrangement.

4. The method of claim 1, in which the vacuum assembly includes a third chamber, the third chamber having a third volume, the vacuum pump further including a third suction inlet, the third suction inlet being connected to the third chamber, the third volume spatially surrounding the second suction inlet, the method further comprising:

sealing the third suction inlet against the external pressure.

5. The method of claim 4, in which the second chamber thermally isolates the first chamber from the third chamber.

6. The method of claim 5, in which the vacuum assembly further includes a heating device positioned within the first chamber.

7. The method of claim 4, in which the first, second, and third chamber include a corresponding first, second, and third outer wall; a first mechanical connection and a second mechanical connection, the first mechanical connection interposing the first outer wall and the second outer wall, the second mechanical connection interposing the second outer wall and third outer wall, the first and second mechanical connections having a lower thermal conductivity than each of the outer walls.

8. The method of claim 1, in which the second volume concentrically surrounds the first suction inlet.

9. The method of claim 4, in which the second volume concentrically surrounds the first suction inlet and the third volume concentrically surrounds the second suction inlet.

10. The method of claim 1, in which the second suction inlet includes a deformable seal; and the first suction inlet includes a metal-to-metal seal that does not have plastic deformation.

11. The method of claim 4, in which the third suction inlet includes a deformable seal; and the first suction inlet and the second suction inlet include a metal-to-metal seal that does not have plastic deformation.

12. The method of claim 1, in which the pressure within the first suction inlet is below $10^{-9}$ mbar.

13. The method of claim 1, in which the analyzer is positioned within the first chamber.

14. The method of claim 1, in which the analyzer is a mass analyzer.

15. The method of claim 1, in which the second chamber is at a higher pressure than the first chamber.

* * * * *